United States Patent [19]

Wagner

[11] Patent Number: 4,682,933

[45] Date of Patent: Jul. 28, 1987

[54] LABYRINTHINE TURBINE-ROTOR-BLADE TIP SEAL

[75] Inventor: William R. Wagner, Los Angeles, Calif.

[73] Assignee: Rockwell International Corporation, El Segundo, Calif.

[21] Appl. No.: 865,924

[22] Filed: May 14, 1986

Related U.S. Application Data

[63] Continuation-in-part of Ser. No. 661,950, Oct. 17, 1984, abandoned.

[51] Int. Cl.[4] ..... F01D 5/20

[52] U.S. Cl. ..... 415/172 A; 416/228

[58] Field of Search ..... 416/228 R, 235, 236 R; 415/172 A, 172 R

[56] References Cited

U.S. PATENT DOCUMENTS

| | | | |
|---|---|---|---|
| 2,378,372 | 6/1945 | Whittle | 415/172 A |
| 2,622,843 | 12/1952 | Williams | 415/172 A |
| 3,082,010 | 3/1963 | Morley et al. | 415/172 A |
| 3,885,886 | 5/1975 | Richter | 416/228 |
| 4,239,452 | 12/1980 | Roberts, Jr. | 415/172 A |
| 4,247,254 | 1/1981 | Zelahy | 415/172 A |
| 4,390,320 | 6/1983 | Eiswerth | 416/228 |
| 4,411,597 | 10/1983 | Koffel et al. | 416/228 |
| 4,424,001 | 1/1984 | North et al. | 415/172 A |

FOREIGN PATENT DOCUMENTS

| | | | |
|---|---|---|---|
| 134451 | 10/1929 | Switzerland | 415/172 A |
| 2105415 | 3/1983 | United Kingdom | 415/172 A |

*Primary Examiner*—Carlton R. Croyle
*Assistant Examiner*—Donald E. Stout
*Attorney, Agent, or Firm*—H. Fredrick Hamann; Harry B. Field; David C. Faulkner

[57] ABSTRACT

Means for sealing the tip 18 of a rotor turbine blade 10 against tip leakage flow comprising a multiplicity of recesses 30 formed in the surface of the tip 18. The recesses 30 are preferably formed in a labyrinthine or slaggered pattern which interposes at least one recess 30 in every leakage flow path across the tip 18 from the pressure side 26 to the suction side 28 of the blade 10.

5 Claims, 4 Drawing Figures

LABYRINTHINE TURBINE-ROTOR-BLADE TIP SEAL

The invention described herein was made in the performance of work under NASA Contract No. NAS8-27980 and is subject to the provisions of Section 305 of the National Aeronautics and Space Act of 1958 (72 Stat. 435; 42 USC 2457).

This is a continuation-in-part of co-pending application Ser. No. 661,950 filed on Oct. 17, 1984, now abandoned.

BACKGROUND OF THE INVENTION

1. Field of the Invention

This invention relates to turbine rotor blades and especially to reducing transverse and chordwise leakage losses at the rotor-blade tip.

2. Description of the Prior Art

The leakage across the surface of turbine rotor blades causes a drop in pressure across the blade, i.e., the difference in pressure between the pressure side and the suction side is reduced. This degrades the performance of the turbine.

Blade-tip leakage is presently controlled by utilizing tight tip clearances which can result in rubbing between the blade tip and the casing and blade breakage under thermal and centrifugal growth effects.

OBJECTS OF THE INVENTION

An object of the present invention is to minimize fluid leakage across the tip of rotor blades in turbine and pump rotors of the axial and centrifugal blading types.

Another object is to improve the performance of turbine rotor blade assemblies.

Other objects, advantages and novel features of the present invention will become apparent from the following detailed description of the invention when considered in conjunction with the accompanying drawing.

SUMMARY OF THE INVENTION

The present invention comprises a plurality of recesses machined into the surface of the tip of a turbine rotor blade. The pattern of the recesses preferably interrupts all straight paths for fluid leakage between the pressure and suction sides of the blade by interposing at least one recess in every leakage path. The recesses establish turbulence in the leakage paths which will diminish leakage flow, thereby effectively providing a sealing means against tip leakage.

BRIEF DESCRIPTION OF THE FIGURES

The same elements or parts throughout the figures of the drawing are designated by the same reference characters.

DETAILED DESCRIPTION OF THE INVENTION

Figure 1:
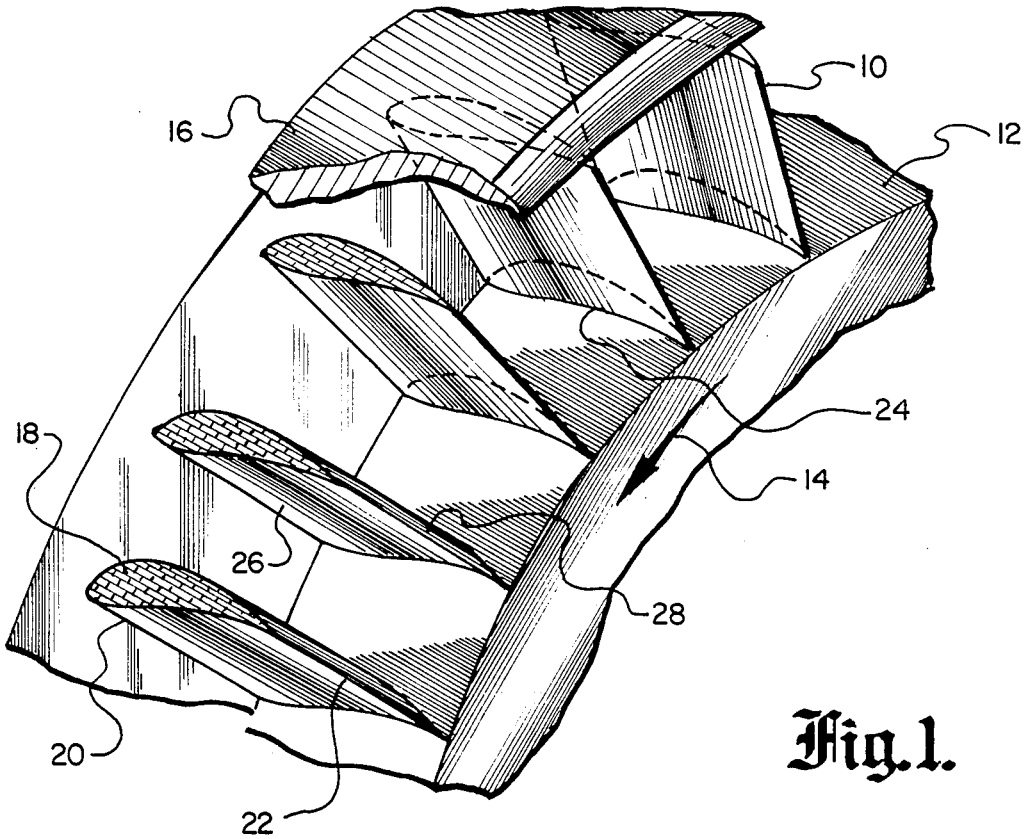
FIG. 1 is a partial schematic view of the rotor blades and casing of a turbine rotor blade assembly.

A portion of a typical turbine rotor blade assembly is shown schematically in FIG. 1. Rotor blades 10 are affixed to a rotor 12 and rotate in the direction of the arrow 14. The blades 10 and rotor 12 are surrounded by a casing or shroud 16 providing a narrow gap, δ, (see FIG. 4) between the casing 16 and the tip 18 of each rotor blade. Each blade 10 has a leading edge 20 and a trailing edge 22, a tip 18 and a root 24 (the bottom of the blade 10 attached to the rotor 12), a pressure side 26 and a suction side 28. Tip leakage is the leakage of a gas or fluid (which is being acted on by the turbine) from the pressure side 26 to the suction side 28 through gap δ and across the blade tip surface.

The relationship between the number of recesses and the location thereof on a given blade tip surface, and the flow rate of fluid leakage across the tip surface and the recesses therein may be expressed by the empirical relationship:

$$\frac{w}{A} = \frac{\sqrt{2g\rho\Delta P}}{\sqrt{C_1 N + C_2}} \tag{1}$$

where:

w = leakage flow rate

A = leakage flow area between a shroud and a tip surface area (delta x chord fraction).

g = gravitational constant (32.2 ft. per sec.$^2$)

ΔP = chordwise pressure differential (suction to pressure side).

ρ = leakage fluid density $C_1$, $C_2$ = flow constants for a given gap distance.

N = number of recesses on at a tip surface area.

In the above equational relationship a proportional increase in $C_1$, $C_2$ and recess number substantially reduces the fluid leakage flow rate at any blade tip surface area. The values of the constants $C_1$ and $C_2$ are within the range:

$$0 \leqq C_1 < 2.2$$

$$1 \leqq C_2 \leqq 2.4$$

Preferred ranges for $C_1$ and $C_2$ determined by empirical flow tests would be about 1.4 and 2.0, respectively.

The values of constants $C_1$ and $C_2$ increase toward the maximums shown above as the ratio of Z/δ increases. For example, given a tip clearance of about 0.005 inch and an increase in the ratio of Z/δ to about 50, the value of Z would be about 0.25 inch.

Figure 3:
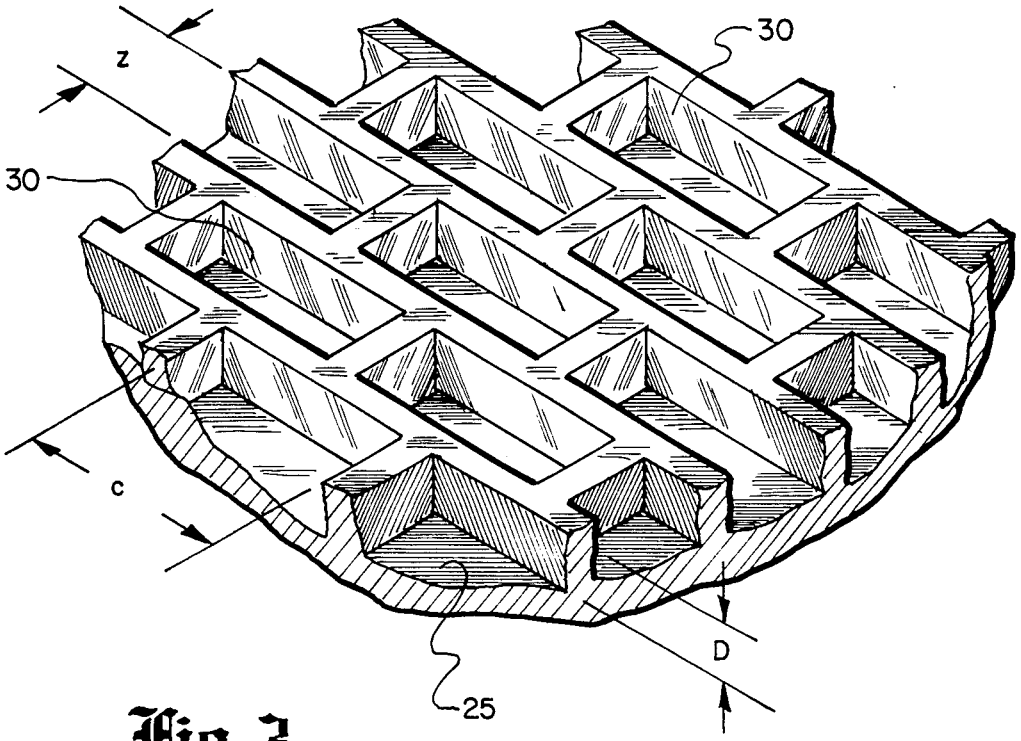
FIG. 3 is a schematic illustration of a preferred embodiment of the invention.
Figure 4:
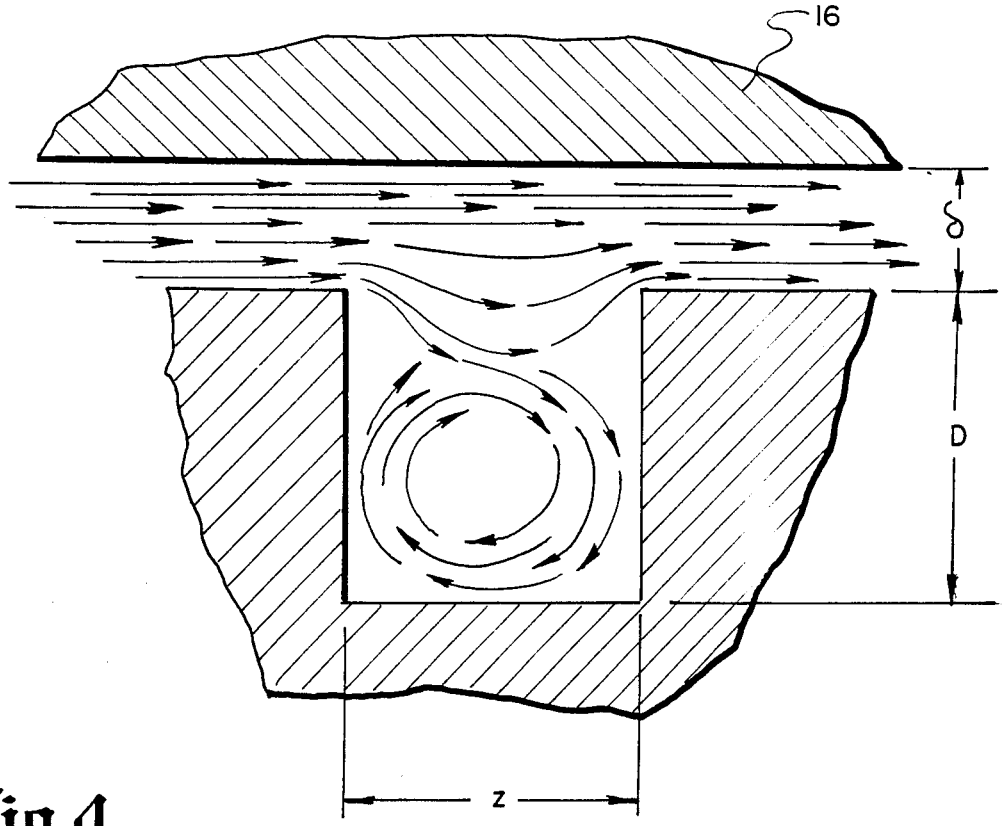
FIG. 4 is a schematic cross-section of a blade tip recess illustrating the fluid flow and vortex effect.

Referring to FIGS. 3 and 4, the depth, D, of each recess with respect to the solid base or bottom 25 thereof is related to the recess width Z, preferably in the general range, $1 \leqq D/Z \leqq 3$ with the value for the tip-casing gap, δ, being in the general range $1 \leqq Z/\delta \leqq 30$. The number of recesses is a function of the clearance, or gap, δ, and the blade width at the location of a particular recess. With the ratios provided above for δ/Z and D/Z, the value of Z would not fall lower than one δ. For maximum efficiency, the maximum number of recesses 30 will be in the mid-chord region of the blade 10. For example, a typical tapered turbine blade as seen in the Figures would have a maximum rotor blade tip surface width at chord midspan of about 1 inch, a blade height of 2 inches and a 2-inch chord. Given these blade dimensions, the following values in fractions of an inch are derived empirically from the formula (1):

δ = 0.005

Z = 0.120

D=0.120 c=0.120

In this example the recesses 30 are machined into the tip surface to effect a concentration of recesses in the range of from about 6 to about 10 recesses per inch of blade width section.

FIG. 4 illustrates the behavior of the vortex pattern in each recess during operation of the rotor blade assembly. The vortex pattern generates a vacuum effect which increases the turbulence as the fluid flow moving across each recess surface dips into each recess the flow encounters. The recesses thus restrain fluid flow thereby effectively providing blade tip sealing.

Figure 2:
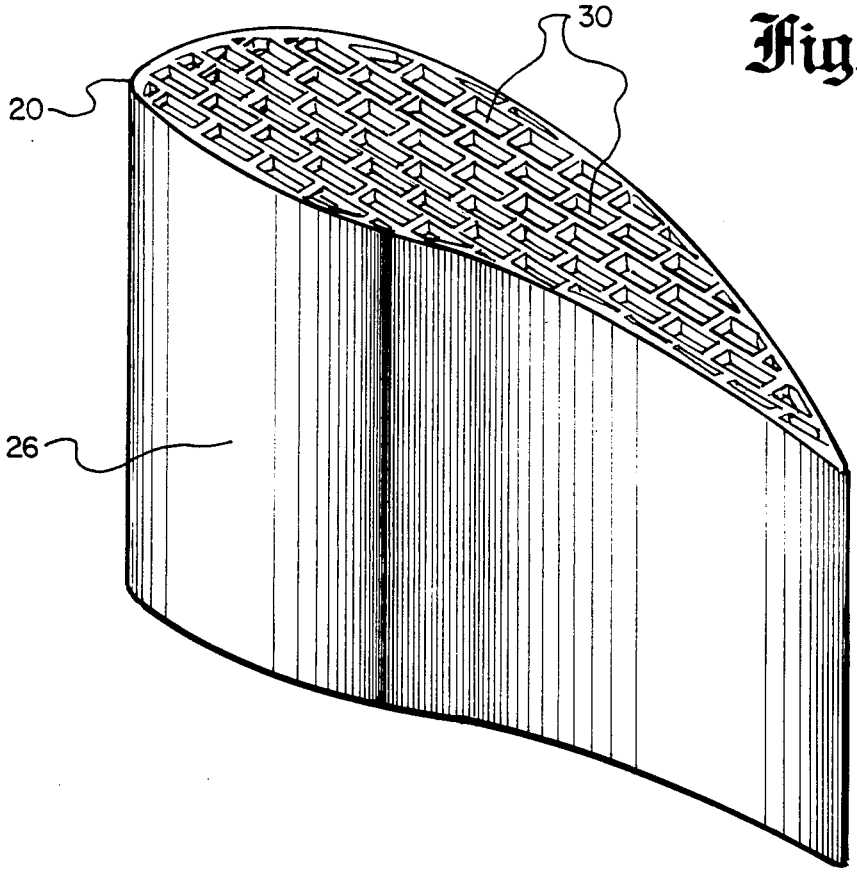
FIG. 2 is a schematic illustration of the tip surface of a rotor blade in accordance with the invention.

The staggered recess configuration of FIG. 2 is preferred to an in-line configuration since there will be no flow path across the tip 18 which does not have at least one recess 30 across it to impede free flow.

The flow reductiion afforded by the tip recesses can reduce the leakage by a factor of 2–3 for a fixed minimum clearance and yield up to 5% improved efficiency in turbine performance. Turbine blade assemblies with small turbine-blade height will benefit more from this concept because of their innately lower efficiency caused generally by a greater tip clearance-to-blade-height ratio.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A method for minimizing a fluid leakage flow rate across a rotor blade tip during operation of a rotor blade assembly having a casing, a rotor positioned within the casing, at least one rotor blade attached to the rotor, the rotor blade having a leading edge, a trailing edge, a tip including a tip surface spaced from the casing by a gap, a root portion, a pressure side and a suction side, a fluid flow across the blade tip from the pressure side to the suction side, the method comprising:

(i) determining a fluid flow relationship between a fluid leakage flow rate across the blade tip surface, a fluid leakage flow area on the tip surface, and the gap between the casing and the tip surface according to the formula $$\frac{w}{A} = \frac{\sqrt{2g\rho\Delta P}}{\sqrt{C_1N + C_2}} \qquad (1)$$

where:

w=leakage flow rate,

A=leakage flow area between a shroud and a tip surface area (delta x chord fraction), g=gravitational constant (32.2 ft. per sec.$^2$), ΔP=chordwise pressure differential (suction to pressure side), ρ=leakage fluid density, C hd 1 l , C hd 2=flow constants for a given gap distance, N=number of recesses on at a tip surface area, (ii) deriving a number of recesses based on the derivative values of C hd 1 l and C hd 2 l of formula (1), (iii) machining the recesses into the blade tip surface in conformity with formula $$1 \leqq D/Z \leqq 3 \qquad (a)$$

wherein D is the recess depth and Z is the recess width, and the formula $$1 \leqq Z/\delta \leqq 30 \qquad (b)$$

wherein δ is the gap value between the casing and the blade tip surface and Z is as above, (iv) establishing suction vortices within each recess, (v) diverting at least a portion of the fluid flowing from the pressure side to the suction side into each recess; and (vi) minimizing the fluid flow across the blade tip surface.

2. A method according to claim 1 wherein the value of C hd 1 l is about 1.4.

3. A method according to claim 1 wherein the value of C hd 2 l is about 2.0.

4. A method according to claim 1 wherein the recesses are machined into the tip surface in a staggered configuration.

5. A method according to claim 1 wherein the recesses are machined into the tip surface to effect a concentration of recesses in the range of from about 6 to about 10 recesses per inch of blade width section.

* * * * *

UNITED STATES PATENT AND TRADEMARK OFFICE

CERTIFICATE OF CORRECTION

PATENT NO. : 4,682,933

DATED : July 28, 1987

INVENTOR(S) : William R. Wagner

It is certified that error appears in the above-identified patent and that said Letters Patent is hereby corrected as shown below:

In the ABSTRACT, line 5 correct "slaggered" to read --staggered--.

Signed and Sealed this

First Day of December, 1987

*Attest:*

DONALD J. QUIGG

*Attesting Officer*

*Commissioner of Patents and Trademarks*